US008079403B2

(12) United States Patent
Kollotzek

(10) Patent No.: US 8,079,403 B2
(45) Date of Patent: Dec. 20, 2011

(54) CASTING CORE FOR FORMING A COOLING CHANNEL

(75) Inventor: Helmut Kollotzek, Mutlangen (DE)

(73) Assignee: MAHLE International GmbH, Stuttgart (DE)

( * ) Notice: Subject to any disclaimer, the term of this patent is extended or adjusted under 35 U.S.C. 154(b) by 315 days.

(21) Appl. No.: 12/386,640

(22) Filed: Apr. 21, 2009

(65) Prior Publication Data

US 2009/0261232 A1 Oct. 22, 2009

(30) Foreign Application Priority Data

Apr. 22, 2008 (DE) ..... 10 2008 020 231

(51) Int. Cl.
*F01P 1/04* (2006.01)

(52) U.S. Cl. ..... 164/369; 164/348; 164/373; 123/41.35; 123/196.6; 92/186

(58) Field of Classification Search ..... 164/137, 164/340, 369, 373; 123/41.35, 193.6; 92/186
See application file for complete search history.

(56) References Cited

U.S. PATENT DOCUMENTS 3,865,179 A * 2/1975 Steinwart et al. ..... 164/340
2009/0025550 A1* 1/2009 Benz et al. ..... 92/186

FOREIGN PATENT DOCUMENTS

DE 10 2007 044 105 10/2008
JP 2006090159 A * 4/2006

* cited by examiner

*Primary Examiner* — Jessica L Ward
*Assistant Examiner* — Devang R Patel
(74) *Attorney, Agent, or Firm* — Collard & Roe, P.C.

(57) ABSTRACT

A soluble casting core for forming a cooling channel in a piston has a formed-on part for forming an oil supply opening and a formed-on part for forming an oil drain opening. In order to improve the mechanical strength of the piston, the oil supply opening and the oil drain opening lie in a different pin boss support of the pin bosses of the piston. A third formed-on part, which lies in the circumferential direction and is configured in oblong manner, is disposed between the first formed-on part and the end of the casting core, which part has a shape that narrows conically towards the end of the casting core and forms a continuation of the cooling channel, which narrows conically towards the end of the cooling channel.

4 Claims, 3 Drawing Sheets

CASTING CORE FOR FORMING A COOLING CHANNEL

CROSS REFERENCE TO RELATED APPLICATIONS

Applicant claims priority under 35 U.S.C. 119 of German Application No. 10 2008 020 231.2 filed Apr. 22, 2008.

BACKGROUND OF THE INVENTION

1. Field of the Invention

The invention relates to a casting core for forming a cooling channel.

2. The Prior Art

A soluble casting core for forming a cooling channel in a piston produced using casting technology is known from German Patent Application No. 10 2007 044 105.5, whereby the casting core has a formed-on part for forming an oil supply opening, and another formed-on part for forming the oil drain opening of the cooling channel. The piston undergoes different deformations during engine operation, due to the gas pressure in the combustion chamber, the very high temperatures that prevail in the combustion chamber, and the mechanical stresses of the major thrust side and the minor thrust side of the piston. These deformations lead to great stress in the region between the oil supply opening and the oil drain opening, so that there is the risk of crack formation in this region, if the oil supply opening and the oil drain opening have too small a distance from one another.

SUMMARY OF THE INVENTION

It therefore an object of the invention to avoid this problem. The problem is solved with a soluble casting core, in the form of an open ring, for forming a cooling channel in a cast piston, the piston having two pin bosses that are formed onto the piston crown by way of a pin boss support. The beginning of the casting core makes a transition, by way of a core bend in the shape of a quarter circle, into a fourth formed-on part disposed at least approximately parallel to the axis of symmetry of the casting core, for forming an oil supply opening of the cooling channel. The casting core, in the region of its end, has a first formed-on part which points in the same direction as the fourth formed-on part, for forming a first oil drain opening in the region of the end of the cooling channel.

The first and the fourth formed-on part are disposed in such a manner that the oil supply opening formed by the fourth formed-on part is disposed in the region of the pin boss support of one of the two pin bosses, and the first oil drain opening formed by the first formed-on part is disposed in the region of the pin boss support of the other of the two pin bosses. Both the oil supply opening and the first oil drain opening are disposed either on the major thrust side or on the minor thrust side of the piston. A third formed-on part, which lies in the circumferential direction and is configured in an oblong manner, is disposed between the first formed-on part and the end of the casting core, for forming a continuation between the first oil drain opening and the end of the cooling channel.

In one embodiment, the third formed-on part has a shape that narrows conically towards the end of the casting core. The casting core has a second formed-on part disposed on the side of the casting core that lies opposite the first and the fourth formed-on part, and points in the same direction as the fourth formed-on part, for forming a second oil drain opening of the cooling channel.

In another embodiment, the third formed-on part has a top side that lies parallel to a plane that is perpendicular to the axis of symmetry of the casting core, for forming a ceiling of the continuation of the cooling channel that lies parallel to the piston crown, on the piston crown side. The third formed-on part has an underside that runs at a slant towards the plane that lies perpendicular to the axis of symmetry, proceeding from the first formed-on part all the way to the end of the casting core, for forming a floor of the continuation of the cooling channel that is inclined at a slant towards the piston crown.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
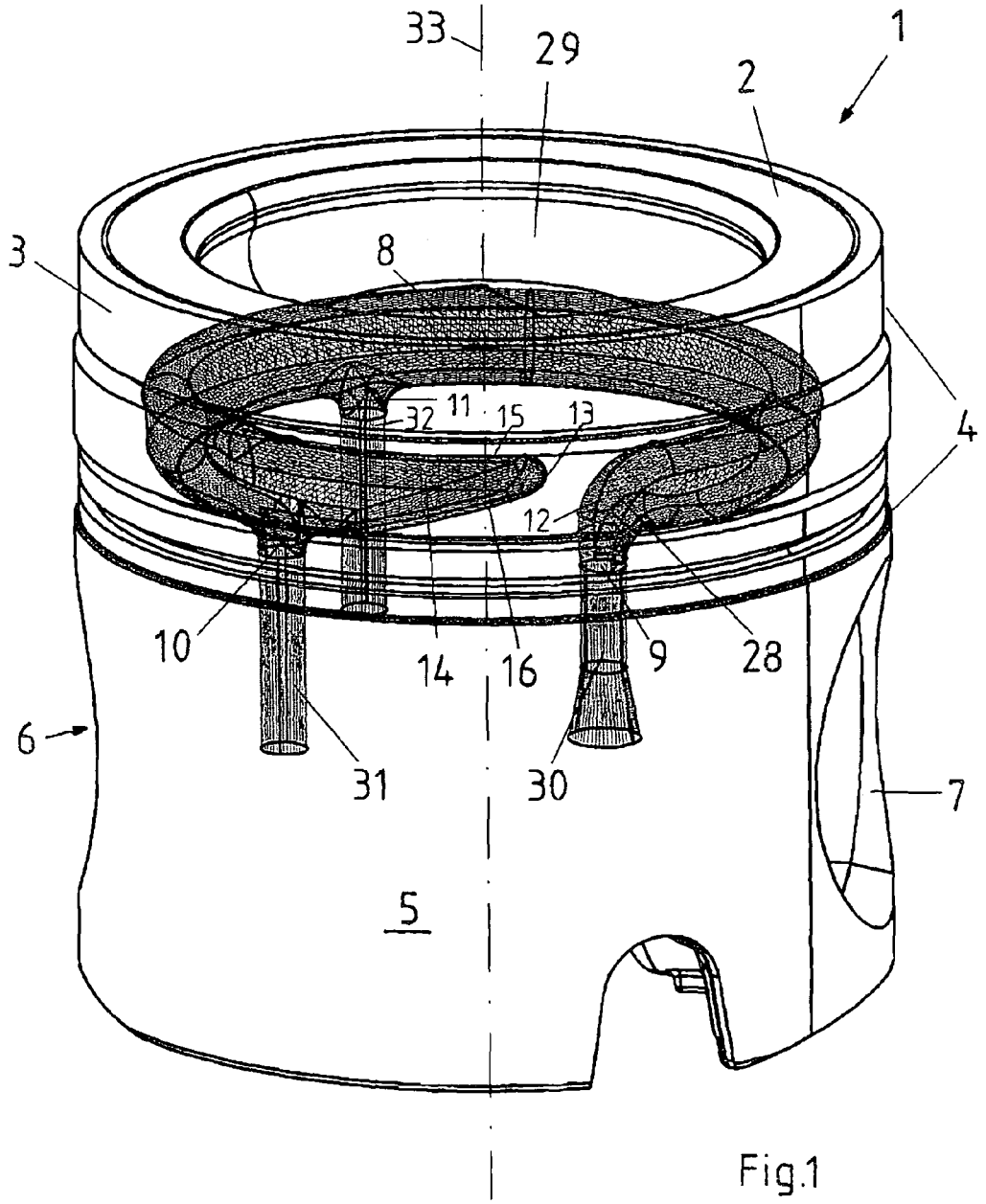
FIG. 1 shows a piston having a cooling channel produced using a casting core according to an embodiment of the invention.

FIG. 1 shows a piston 1 having a piston crown 2, with a ring belt 4 formed onto the piston crown 2 by way of a top land 3. There is a skirt element 5 connected with the ring belt 4, and having two pin bosses 6 and 7, which are connected with the skirt element 5 and with the ring belt 4 and with the piston crown 2 by way of a pin boss support (not shown in FIG. 1). The piston 1 furthermore has a combustion bowl 29 that is formed into the piston crown 2.

Also shown in the drawing of FIG. 1 is a cooling channel 8, which is disposed in the vicinity of the piston crown, radially on the outside, circumferentially, and forms an open ring. At its beginning 12, the cooling channel 8 has an oil supply opening 9, and in the region of its end 13, has a first oil drain opening 10. A second oil drain opening 11 is disposed on the side of the piston 1 that lies opposite the oil supply opening 9 and the first oil drain opening 10. The oil supply opening 9 and the two oil drain openings 10 and 11 are oriented in the direction of the piston interior. In this connection, as is particularly evident from FIG. 2, which a bottom view of the piston 1, the oil supply opening 9 is disposed close to the pin boss 7 (in the region of its pin boss support), and the first oil drain opening 10 is disposed close to the pin boss 6 (in the region of its pin boss support). The oil supply opening 9 and the first oil drain opening 10 are disposed on that side of the piston on which the skirt element 5 is also situated. In this connection, the skirt element 5 can lie on the major thrust side or on the minor thrust side of the piston 1, depending on how the piston 1 is installed into an engine.

Cooling channel 8, considered from the side between its end 13 and the first oil drain opening 10 (see FIG. 1), is configured as a continuation 14 that narrows conically towards the end 13. Ceiling 15 of the continuation 14, on the piston crown side, lies parallel to the piston crown 2, and its floor 16, which faces away from the piston crown, is inclined at a slant relative to the piston crown 2. FIG. 1 also shows the bores 30, 31, and 32, which are made in the finished piston 1 in order to connect the oil supply opening 9 and first and second oil drain opening 10 and 11 with the piston interior.

Figure 2:
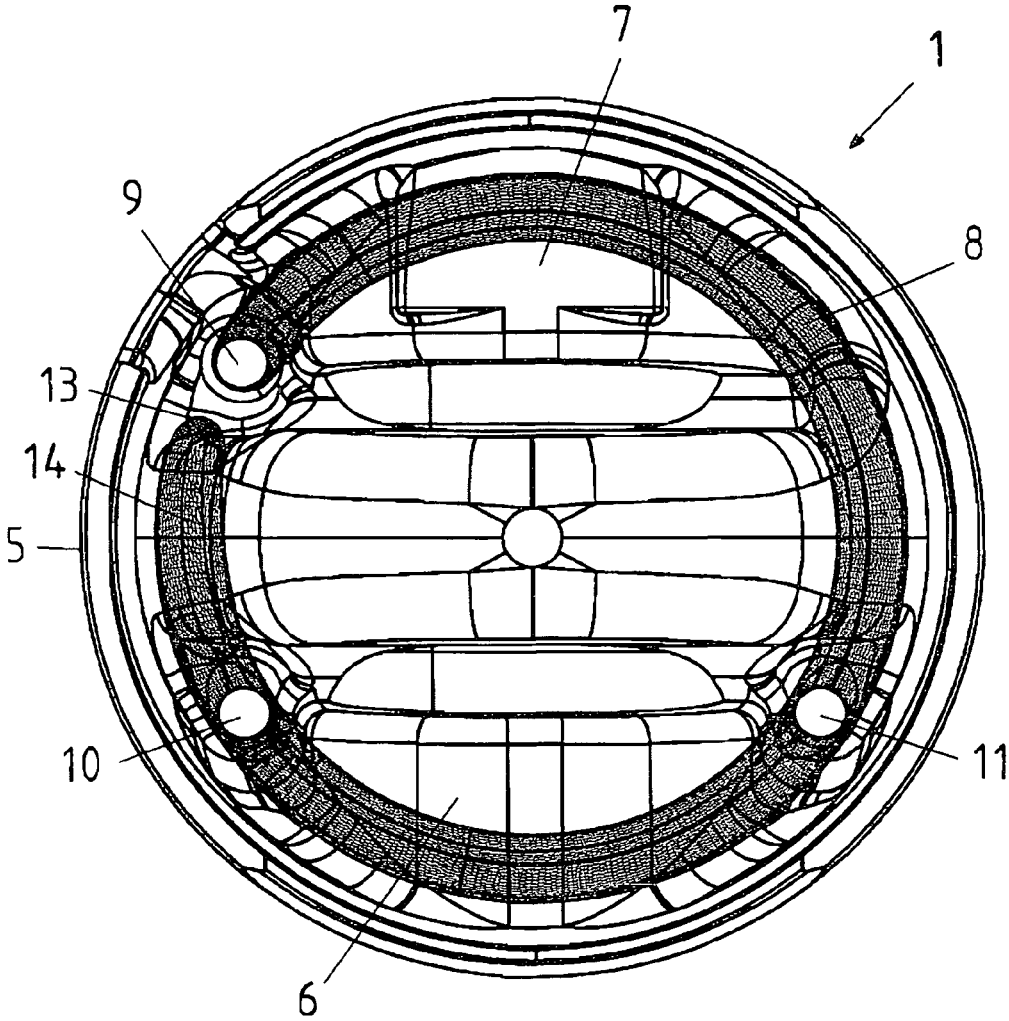
FIG. 2 is a bottom view of the piston according to FIG. 1, in which the cooling channel is shown in the drawing.

In FIG. 2, the bottom view of the piston 1, the cooling channel 8 with its continuation 14 is shown, in addition to the pin bosses 6 and 7, the oil supply opening 9, the first oil drain opening 10, and the second oil drain opening 11.

Figure 3:
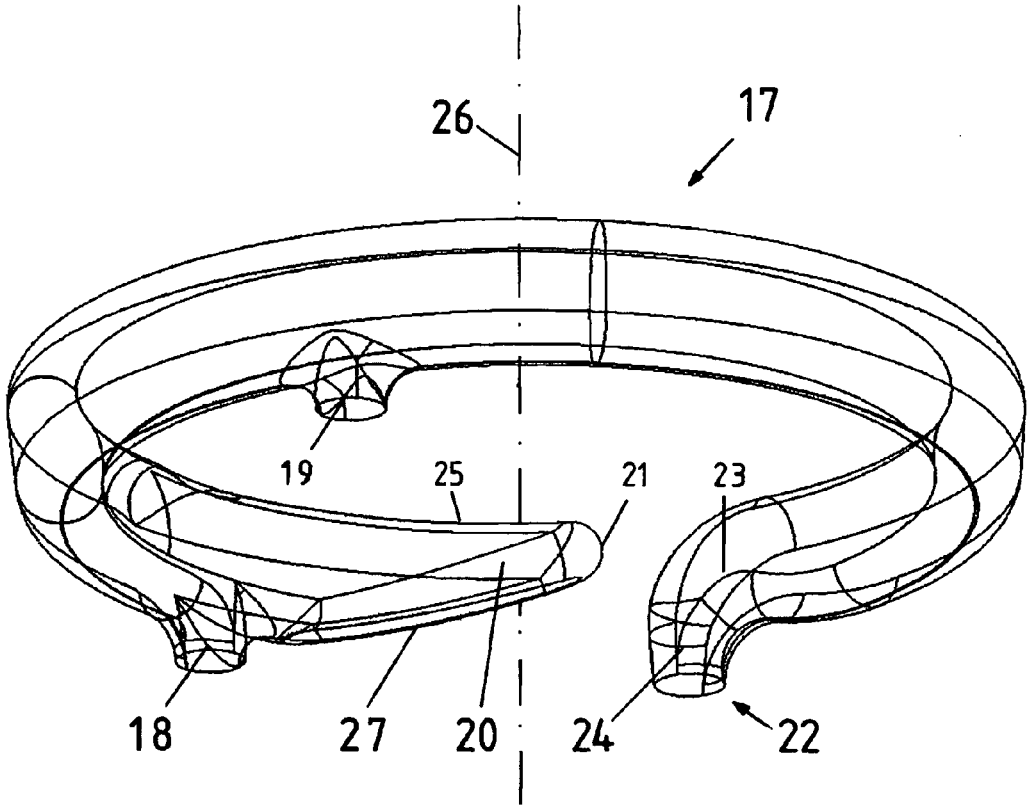
FIG. 3 is a representation of the casting core according to an embodiment of the invention, for production of the cooling channel.

FIG. 3 shows a casting core 17 in the form of an open ring, which is used to produce the cooling channel 8, and which consists of a material that is soluble by means of water or by means of a special fluid. Preferably, the casting core 17 consists of water-soluble salt or of sand. A casting core 17 that consists of sand is given a sufficiently stable shape for the casting process, by means of a water-soluble binder. In the region of its end 21, the casting core 17 has a first formed-on part 18 for forming a first oil drain opening 10. A second formed-on part 19 for forming the second oil drain opening 11 is disposed on the side of the casting core 17 that lies opposite the end 21.

A third formed-on part 20 between the first formed-on part 18 and the end 21 of the casting core 17, having a shape that narrows conically towards end 21 of the casting core 17, serves to form the continuation 14 of the cooling channel 8 during casting of the piston 1. The top side 25 lies parallel to a plane that is perpendicular to the axis of symmetry 26 of the casting core 17. An underside 27 runs at a slant towards this plane that lies perpendicular to the axis of symmetry 26, proceeding from the first formed-on part 18, all the way to the end 21 of the casting core 17. At the beginning 22 of the casting core 17, a fourth formed-on part 24 is disposed, by way of a core bend 23 in the shape of a quarter circle, which part serves to form the oil supply opening 9 during casting of the piston 1. In this connection, the first, second, and fourth formed-on parts 18, 19, and 24 lie on the underside of the casting core 17, and parallel to the axis of symmetry 26 of the casting core.

During casting of the piston 1, the casting core 17 is laid into the casting mold and fixed in place at a certain distance from the bottom of the casting mold, thereby determining the thickness of the piston material provided between cooling channel 8 and piston crown 2. After casting, the 1st, 2nd, and 4th formed-on parts 18, 19, and 24 are drilled, and the casting core 17 is washed out using a suitable fluid, by way of these bores 30, 31, 32 (FIG. 1). This fluid can be water, if, as indicated above, the casting core 17 consists of salt or of sand with a water-soluble binder.

The casting core 17, with its 4th formed-on part 24, lying parallel to the axis of symmetry 26, forms the oil supply opening 9, into which the subsequent core bend 23, in the shape of a quarter circle, makes a transition into the rest of the casting core 17, by way of the 4th formed-on part. The 3rd formed-on part 20 forms the continuation 14 of the cooling channel 8. This all results, within the framework of casting the piston 1, in a cooling channel 8 whose oil supply opening 9, lying parallel to the axis of symmetry 26, can be hit well by an oil jet directed parallel to the axis of symmetry 26 of the cooling channel 8, which corresponds to the axis 33 of the piston 1, independent of the position of the piston 1. In this way, a very good degree of capture (degree of feed effect of the cooling oil to the piston) is obtained.

In the cooling channel 8, the core bend 23 of the casting core 17, in the shape of a quarter circle, leads to a channel transition 28 between oil supply opening 9 and the rest of the cooling channel 8, having the same shape. In this way, the oil injected into the oil supply opening 9 is deflected in ideal manner, in terms of flow technology, and passed through the cooling channel 8 at an increased flow speed.

The continuation 14 of the cooling channel 8, produced by means of the 3rd formed-on part 20 of the casting core 17, brings about the result that even the enlarged region between the oil supply opening 9 and the first oil drain opening 10 is cooled well. In engine operation, the cooling oil exits out of the cooling channel 8 only in part, by way of the first oil drain opening 10, and for the most part continues to flow into the continuation 14, due to its mass inertia, in order to cool this piston region between oil supply opening 9 and 1st oil drain opening 10. The slanted floor 16 of the continuation 14 then brings about an improved return flow of the oil, which then flows completely out of the first oil drain opening 10.

The second oil drain opening 11 created by the second formed-on part 19 of the casting core 17 is optional and is only formed into the cooling channel 8 for the event that the amount of oil in the cooling channel 8 is too great, on the basis of the cooling oil supply (volume flow, jet quality), and thus there is a flow hindrance, i.e. a hindrance in the shaker effect of the cooling oil. Since the cooling efficiency would deteriorate as a result, part of the cooling oil is passed out through the 2nd oil drain opening 11, so that the remaining rest of the oil can optimally cool the piston region between the 2nd oil drain opening 11 and the end 13 of the cooling channel 8.

A greater distance is implemented between the oil supply opening 9 and the first oil drain opening 10, by means of a correspondingly configured casting core 17. Ideally, the oil supply opening 9 and the first oil drain opening are formed into the underside of the piston crown 2 in the region of the pin boss supports of the pin bosses 6 and 7. This is where the bores 30, 31 required for the oil supply opening 9 and the first oil drain opening 10 are situated in a region of the piston 1 that is less subject to stress from the lateral forces. The corresponding bores 30, 31 can be implemented in optimized manner, in terms of design and strength, in connection with the pin boss connections.

In engine operation, the piston is deformed under the effect of the gas pressure in the combustion chamber. The piston crown 2 is bent through towards the inside. The piston undergoes another deformation, because of the very high temperatures that prevail in the piston. In this deformation, the piston crown is domed out, and the diameter of the piston crown is increased. Furthermore, very great forces act on the major thrust side and the minor thrust side of the piston skirt, during engine operation, and as a result, the lower, open end of the piston skirt is deformed ovally. As a result of these deformations of the piston 1 during engine operation, the piston region between the oil supply opening 9 and the first oil drain opening 10, in particular, is subject to very great stress. For this reason, an overly small land between the oil supply opening 9 and the first oil drain opening 10, which comes about if the oil supply opening 9 and the first oil drain opening 10 have too small a distance from one another, tends to result in crack formation and breakage. Increasing the size of this distance increases the amount of the piston material, and thus the strength of the region between the oil supply opening 9 and the first oil drain opening 10, so that the entire piston 1 can be exposed to greater thermal and mechanical stress.

Accordingly, while only a few embodiments of the present invention have been shown and described, it is obvious that many changes and modifications may be made thereunto without departing from the spirit and scope of the invention.

REFERENCE SYMBOL LIST

1 piston
2 piston crown

3 top land
4 ring belt
5 skirt element
6, 7 pin boss
8 cooling channel
9 oil supply opening
10 1st oil drain opening
11 2nd oil drain opening
12 beginning of the cooling channel 8
13 end of the cooling channel 8
14 continuation of the cooling channel 8
15 ceiling of the continuation 14
16 floor of the continuation 14
17 casting core
18 1st formed-on part
19 2nd formed-on part
20 3rd formed-on part
21 end of the casting core 17
22 beginning of the casting core 17
23 core bend in the shape of a quarter circle
24 4th formed-on part
25 top side of the 3rd formed-on part 20
26 axis of symmetry
27 underside of the 3rd formed-on part
28 channel transition
29 combustion bowl
30, 31, 32 bore
33 axis of the piston 1

What is claimed is:

1. A soluble casting core, in the form of an open ring having a first end and a second end, the first end being open and the second end being closed, for forming a cooling channel in a piston produced using casting technology, the piston having two pin bosses that are formed onto the piston crown by way of a pin boss support, wherein the first end of the casting core forms a core bend in the shape of a quarter circle, into a fourth formed-on part disposed at least approximately parallel to an axis of symmetry of the casting core, said fourth formed on part forming an oil supply opening of the cooling channel and being disposed in a region of a pin boss support of one of the two pin bosses when the piston is cast around the core, wherein the casting core has a first formed-on part near the second end of the casting core, said first formed-on part is open and pointing in a direction parallel to a pointing direction of the forth formed-on part, for forming a first oil drain opening opposite to the oil supply opening, and said first formed-on part extends perpendicular to a bottom surface of the ring, wherein both the oil supply opening and the first oil drain opening are disposed either on a major thrust side or on a minor thrust side of the piston when the piston is cast around the core, and wherein a third formed-on part, which lies in the circumferential direction and is oblong in shape, is disposed between the first formed-on part and the second end of the casting core, for forming a continuation of the cooling channel between the first oil drain opening and the closed end of the cooling channel.

2. The casting core according to claim 1, wherein the third formed-on part has a shape that narrows conically towards the second end of the casting core.

3. The casting core according to claim 1, wherein the casting core has a second formed-on part, disposed on a side of the casting core that lies opposite the first and the fourth formed-on part, and points in the same direction as the fourth formed-on part, for forming a second oil drain opening of the cooling channel.

4. A soluble casting core, in the form of an open ring, for forming a cooling channel in a piston produced using casting technology, the piston having two pin bosses that are formed onto the piston crown by way of a pin boss support, wherein a first end of the casting core forms a core bend in the shape of a quarter circle, into a fourth formed-on part disposed at least approximately parallel to an axis of symmetry of the casting core, said fourth formed on part forming an oil supply opening of the cooling channel and being disposed in a region of a pin boss support of one of the two pin bosses when the piston is cast around the core, wherein the casting core has a first formed-on part in a region of a second end of the casting core, said first formed-on part pointing in a same direction as the fourth formed-on part, for forming a first oil drain opening near an end of the cooling channel, in a region of a pin boss support of the other of the two pin bosses when the piston is cast around the core, wherein both the oil supply opening and the first oil drain opening are disposed either on a major thrust side or on a minor thrust side of the piston when the piston is cast around the core, and wherein a third formed-on part, which lies in the circumferential direction and is oblong in shape, is disposed between the first formed-on part and the second end of the casting core, for forming a continuation of the cooling channel between the first oil drain opening and the end of the cooling channel, wherein the third formed-on part has a top side that lies parallel to a plane that is perpendicular to the axis of symmetry of the casting core, said top side forming a ceiling of the continuation of the cooling channel that lies parallel to the piston crown, on a piston crown side, and wherein the third formed-on part has an underside that runs at a slant towards a plane that is perpendicular to the axis of symmetry, proceeding from the first formed-on part to the second end of the casting core, for forming a floor of the continuation of the cooling channel that is inclined at a slant towards the piston crown.

* * * * *